US006695570B2

(12) United States Patent
Ford et al.

(10) Patent No.: US 6,695,570 B2
(45) Date of Patent: Feb. 24, 2004

(54) AUTOMATIC CARTON LOADER

(75) Inventors: Colin P. Ford, Woodstock, GA (US); Thomas A. Rice, Cumming, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 122 days.

(21) Appl. No.: 09/962,530

(22) Filed: Sep. 25, 2001

(65) Prior Publication Data

US 2002/0089114 A1 Jul. 11, 2002

Related U.S. Application Data

(60) Provisional application No. 60/261,021, filed on Jan. 11, 2001.

(51) Int. Cl.[7] ..... B65H 11/00
(52) U.S. Cl. ..... 414/798.6; 414/783
(58) Field of Search ..... 271/157; 414/758, 414/773, 783, 798.5, 798.6, 798.7

(56) References Cited

U.S. PATENT DOCUMENTS 4,367,997 A * 1/1983 Schweingruber ..... 414/798.7 X
5,002,457 A * 3/1991 Dorner et al. ..... 414/798.7 X

FOREIGN PATENT DOCUMENTS

JP 3-238237 * 10/1991

* cited by examiner

*Primary Examiner*—Janice L. Kriezek

(57) ABSTRACT

A carton loader for automatically loading stacks of cartons onto a mass feeder for supplying cartons to a packaging machine includes a loader in which stacks of cartons are received and held, and a carriage on which the loader is pivotally mounted. After the stacks of cartons are received, the loader is pivoted from a loading position to a stacking position. The carriage is then moved along the mass feeder for the packaging machine toward a magazine or supply of previously stacked cartons, whereupon the stack of cartons within the loader is moved in engagement and stacked against the previously loaded cartons.

22 Claims, 4 Drawing Sheets

AUTOMATIC CARTON LOADER

This application claims the benefit of Provisional application No. 60/261,021 filed Jan. 11, 2001.

FIELD OF THE INVENTION

The present invention generally relates to carton loaders for packaging machines, and in particular, the present invention relates to a system for receiving stacks of cartons and automatically loading the cartons into a position for feeding into a packaging machine for wrapping products with the cartons.

BACKGROUND OF THE INVENTION

Typically, in the product packaging industry, such as the beverage bottling field, a series of products are passed through a packaging machine wherein groups of products are segmented and wrapped with paperboard cartons. For example, a series of beverage cans can be passed through the packaging machine and wrapped with paperboard cartons in six, eight, or twelve pack configurations. The wrapped products generally then are conveyed further downstream to packaging and palletizing for shipping. Typically, the cartons are preprinted paperboard strips or wraps, generally formed with locking tabs or recesses, and are fed into the packaging machine from a mass feeder. The cartons are fed individually in time with the movement of the products through the packaging machine, so that as the products are segmented into groups, such as six packs, twelve packs, etc., each group is moved in time with a carton that is then placed over and locked about the products.

In the past, the cartons generally have been manually loaded in stacks on the mass feeder for loading into the packaging machine. This generally requires an operator to be present to manually pickup and load stacks of cartons onto the mass feeder for the packaging machine. The machine operator thus generally must continually monitor the level or amount of cartons stacked for loading into the packaging machine so that the stack of cartons waiting to be fed into the packaging machine can be kept relatively constant to ensure the packaging machine will not run out of its supply of cartons during operation. Such a task does not, however, tend to occupy the operator's time completely, and thus simply having an operator stand by the feeder and periodically load new stacks of cartons onto the feeder for feeding into the packaging machine constitutes an inefficient use of the operator's time.

Typically, therefore, the operator will be charged with other tasks that they can perform while they periodically check the feeder to load additional stacks of cartons onto the feeder as needed. If, however, the operator fails to keep up with the supply of cartons on the feeder for the packaging machine, the supply of cartons could run out, thus requiring the packaging machine to be shut down and reprimed, resulting in costly downtime and lost production. In addition, many of the operations in a packaging facility are now highly automated, including the packaging of the products within their carton wraps, as well as the depalletizing and transport of stacks of cartons to the packaging machine. It is accordingly desirable to try to further reduce the amount of manual operations required for the operation of the packaging line to the fullest extent possible, to increase efficiency and lower costs, and to try to reduce risks of workplace injuries such as repetitive strain injuries.

It can be seen that a need therefore exists for a carton loading system for automatically loading cartons onto a mass feeder for a packaging machine that solves the above discussed and other related and unrelated problems in the art.

SUMMARY OF THE INVENTION

Briefly described, the present invention relates to an automatic carton loader for receiving and loading stacks of cartons onto a mass feeder for feeding into a packaging machine. Carton stacks generally are received in the automatic carton loader from a cross-transfer unit or through a manual loading operation. The automatic carton loader generally includes a loader having a guide assembly including a loading chute defined by a pair of opposed chute members that can be spaced at varying positions with respect to each other to accommodate different sized carton blanks or wraps. The loader further generally includes a stacking platform mounted to a rodless cylinder and moveable between the chute members of the loader to move a stack of cartons received thereon from a receiving or loading position to a loaded position between the chute members.

Keeper plates are positioned between the top ends of the chute members and are connected to a keeper plate cylinder, which causes the keeper plates to be moved between a non-engaging or first position, and an engaging or second position wherein the keeper plates are moved over the stack of cartons loaded between the chute members on the stacker platform. In addition, a carton sensor generally is moved from a first, rest position to a second, detecting position extended between the keeper plates with the movement of the keeper plates into their engaging position. The carton sensor detects and halts the approach of the stack of cartons as the top carton moves into engagement with the keeper plates. As a result, the stack of cartons is captured and held for downward movement into a lowered stacking position for feeding into the product packaging machine.

The loader is pivotally mounted on a carriage that conveys the loader longitudinally along a feeder table of the mass feeder for the packaging machine. A pivot cylinder is connected to the loader for controlling the pivoting of the loader from a substantially vertically oriented loading position to a lowered stacking position for transport along the mass feeder table toward a magazine or supply of previously loaded stacks of cartons accumulated on the mass feeder table for feeding into the packaging machine. The pivot cylinder includes an extensible cylinder rod that is attached at one end to the carriage, and a locking collar preventing the cylinder rod from automatically retracting into the cylinder. Once the loader is reoriented into its stacking position, the loader and carriage are moved along the mass feeder table by a drive system that includes a drive motor that drives a pair of drive belts to which the carriage is mounted.

The loader is moved along the mass feeder table until a trailing edge of the previously loaded supply of cartons on the mass feeder table is detected by a magazine stack approach sensor, which signals the control system of the carton loader to slow the movement of the carriage toward the previously loaded stacks of cartons. A second or magazine stack sensor is positioned slightly downstream from the first or magazine stack approach sensor and detects the trailing edge of the previously loaded stack of cartons, the control system halts further movement of the carriage toward the previously loaded cartons, and the keeper plate cylinder retracts the keeper plates and carton sensor to allow the captured stack of cartons within the loader to be discharged. Thereafter, the carriage is moved rearwardly along the mass feeder table toward a home position, while at the same time, the stacker platform is moved forwardly so as to urge the stack of cartons toward and against the rear of the supply of previously loaded cartons. As the carriage is moved into its home position, its presence is detected by first and second carriage position sensors, which accordingly stop the rearward movement of the carriage, after which the loader is pivoted to its vertically oriented loading position.

Once reoriented into its loading position, the loader is ready to receive additional stacks of cartons therein for stacking into the magazine or supply of cartons for feeding into the product packaging machine. The loading sequence is repeated as needed until a sufficient supply of cartons is provided for supplying to the packaging machine. Thereafter, as the magazine or supply of cartons is depleted as cartons are fed into the packaging machine, the automatic carton loader can be engaged to automatically load additional stacks of cartons to maintain a substantially continuous supply of cartons on the mass feeder.

Various objects, features and advantages of the present invention will become apparent to those skilled in the art upon reading the following detailed description, when taken in conjunction with the accompanying drawings.

DETAILED DESCRIPTION OF THE INVENTION

Figure 1:
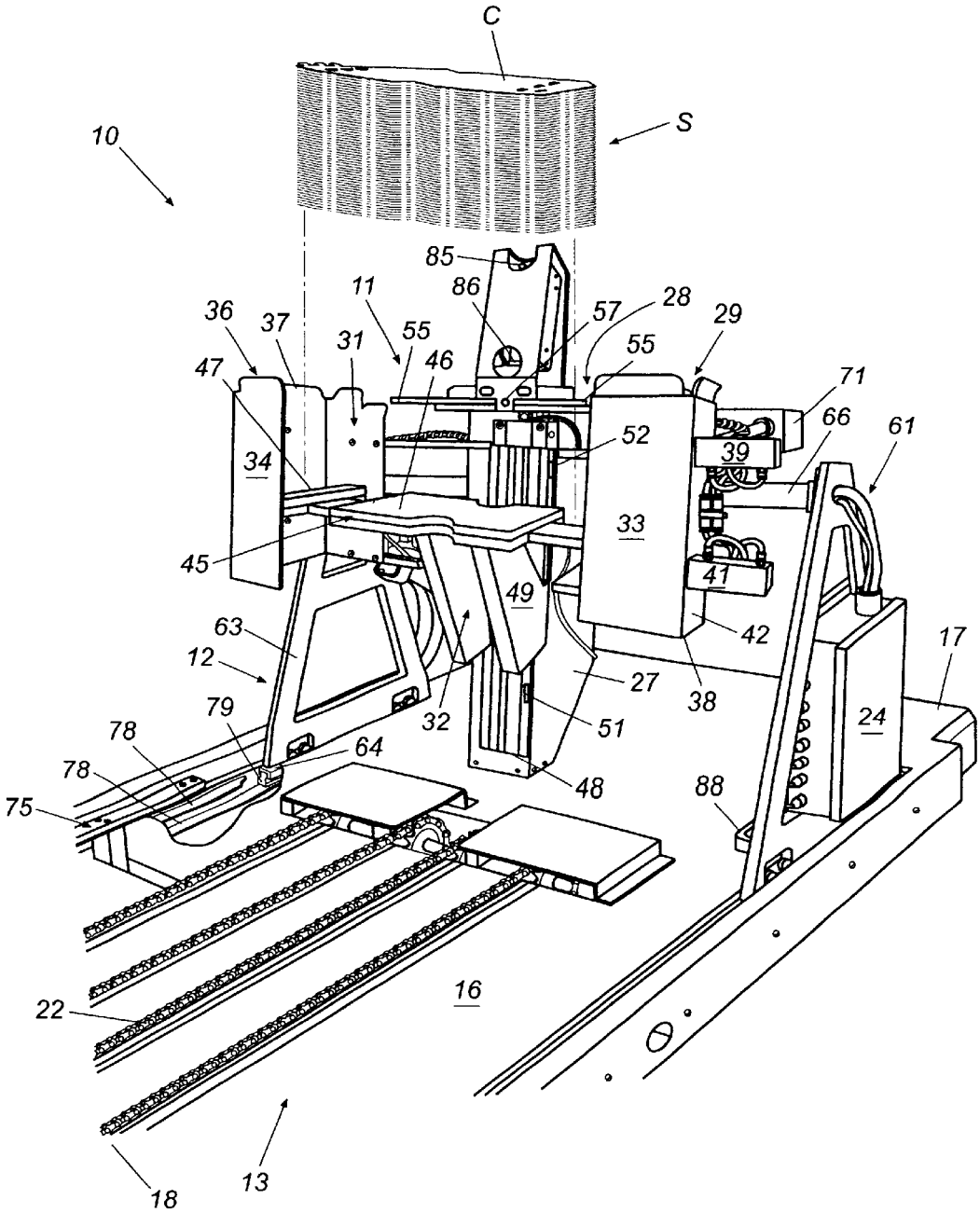
FIG. 1 is a perspective illustration of the automatic carton loader mounted on a mass feeder table for compiling stacks of cartons into a carton supply or magazine for feeding into a packaging machine.

Referring now to the drawings in which like numerals indicate like parts throughout the several views, FIGS. 1–4 illustrate the automatic carton loader 10 of the present invention. The automatic carton loader 10 includes a loader 11 mounted on a moveable carriage 12, so as to be moveable along a mass feeder 13 for a packaging machine (not shown) for delivering stacks S (FIG. 1) of cartons C along the mass feeder into a position for dispensing into the product packaging machine. Typically, the product packaging machine (not shown) will be a packaging machine such as a Marksman 1600 as manufactured by Riverwood International Corporation or similar product packaging machine for packaging products such as bottles, cans or similar products in sets or groups such as four packs, six packs, eight packs, or twelve packs. The stacks S of cartons C are loaded and moved along the length of the mass feeder to form a magazine or accumulated supply 14 (FIG. 4) of previously loaded cartons that will be individually dispensed or fed into the product packaging machine to provide the product packaging machine with a substantially continuous supply of cartons.

Figure 4:
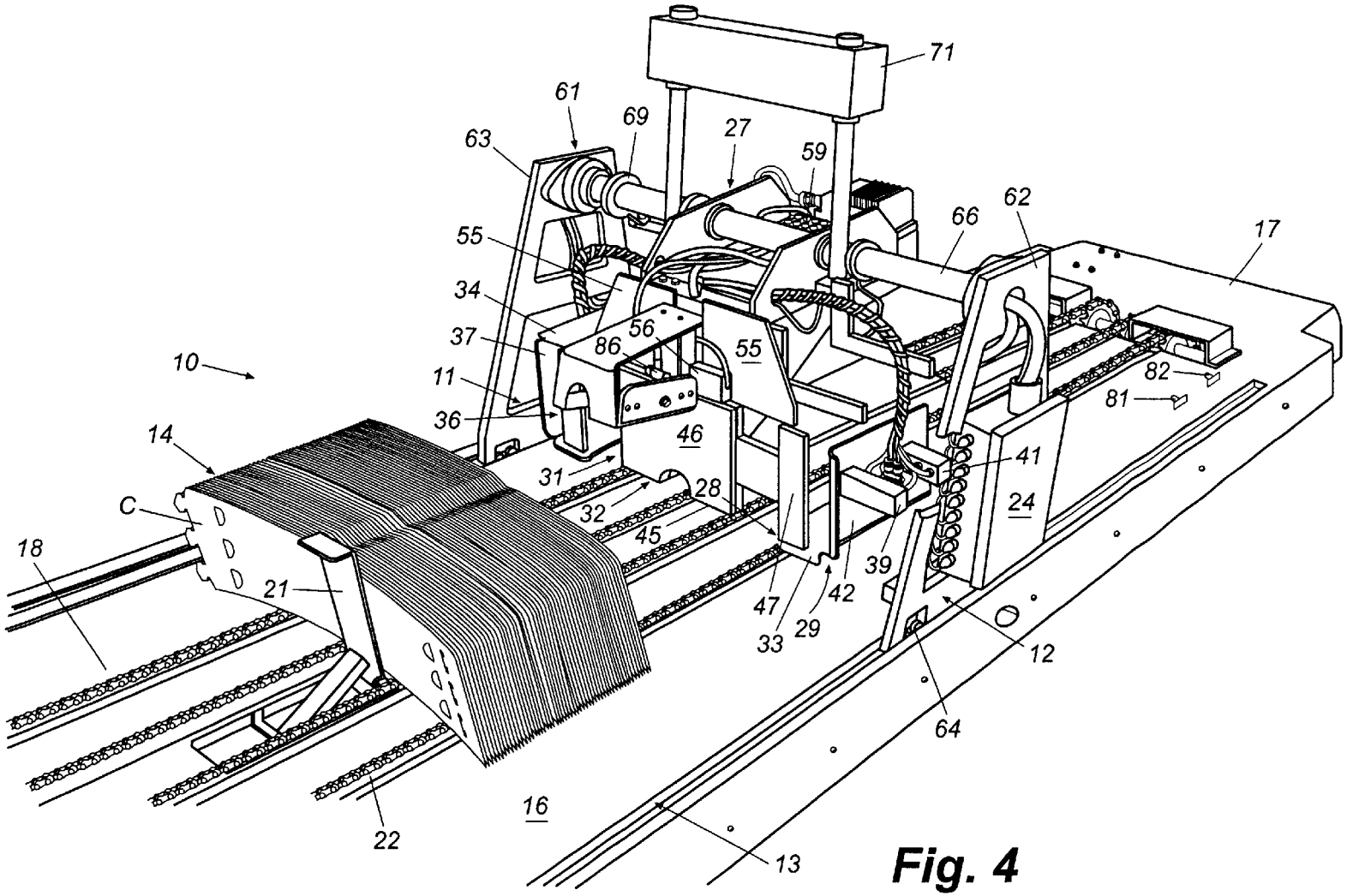
FIG. 4 is a perspective view of the automatic carton loader of FIG. 1 and mass feeder table illustrating the return of the automatic carton loader toward a loading position.

As shown in FIGS. 1 and 4, the cartons C generally are received within the loader 11 in stacks of approximately 500 mm in thickness, although greater or lesser sized stacks of cartons can be loaded as desired, depending upon the particular packaging machine being serviced. The cartons generally are preprinted paperboard carton wraps that are typically rectangular blanks or sheets, sized for wrapping or packaging various product configurations. The loader of the present invention can be designed for use with any size cartons, such as four pack, six pack, eight pack, or larger size cartons, depending upon the products being packaged. The stacks of cartons generally are received within the loader from a transfer mechanism (not shown) such as a robot arm or overhead transfer conveyor that removes the stacks S of cartons C from a pallet or the like and transfers the stacks to the loader or the present invention. The stacks of cartons also can be loaded by a manual loading operation with the operator controlling the loading of the stacks of cartons.

As indicated in FIGS. 1 and 4, the mass feeder 13 generally includes a feeder table 16 having an upstream, first or loading end 17, typically mounted on a support or supports, such as, for example, a stub shaft or support legs that allow the feeder table to pivot thereabout, and a downstream, second or dispensing end 18 that typically is mounted to the packaging machine at a loading end thereof It will be understood by those skilled in the art that the loading end of the packaging machine typically is adjustable vertically to accommodate different height products. Accordingly, with the feeder table being pivotable about the support(s) at its upstream end 17, the downstream end 18 of the mass feeder will be adjustable vertically with the packaging machine to thus change the angle of the mass feeder table as needed to change the angle or orientation of the magazine of cartons being fed to the packaging machine.

As FIG. 4 illustrates, the stacks of cartons are deposited at the second or dispensing end 18 of the mass feeder table 16 and are queued in the carton magazine or supply 14 to provide a substantially continuous supply of cartons for pickup and feeding individually into the packaging machine. Additionally, a magazine plate 21 generally is pivoted between a lowered, at rest position flush with the table 16 of the mass feeder and a raised, engaging position indicated in FIG. 4 for initially stacking the supply of cartons 14 thereagainst. The magazine plate thus provides a bearing surface against which the cartons C of the magazine or supply of cartons are held prior to the startup and for priming of the packaging machine for operation. Once the packaging machine has begun operation and pulling cartons from the magazine or supply of cartons stacked on the mass feeder, the magazine plate is generally moved and maintained in its lowered, at rest or non-engaging position. A feed mechanism 22, here shown as feed chains, is provided along the mass feeder table for indexing the supply of previously loaded cartons forwardly for feeding into the packaging machine.

The automatic carton loader 10 of the present invention generally is controlled by a microprocessor based control system that controls the movement of the loader and carriage for the transport and stacking of cartons against previously loaded supply of cartons accumulated on the mass feeder table 16. A control box 24 is generally mounted along one side of the carriage 12 to provide a primary connection point for the electrical connections for the operative elements of the automatic carton loader. The automatic carton loader 10 also can share or be run from the packaging machine controls and operator interface.

Figure 2:
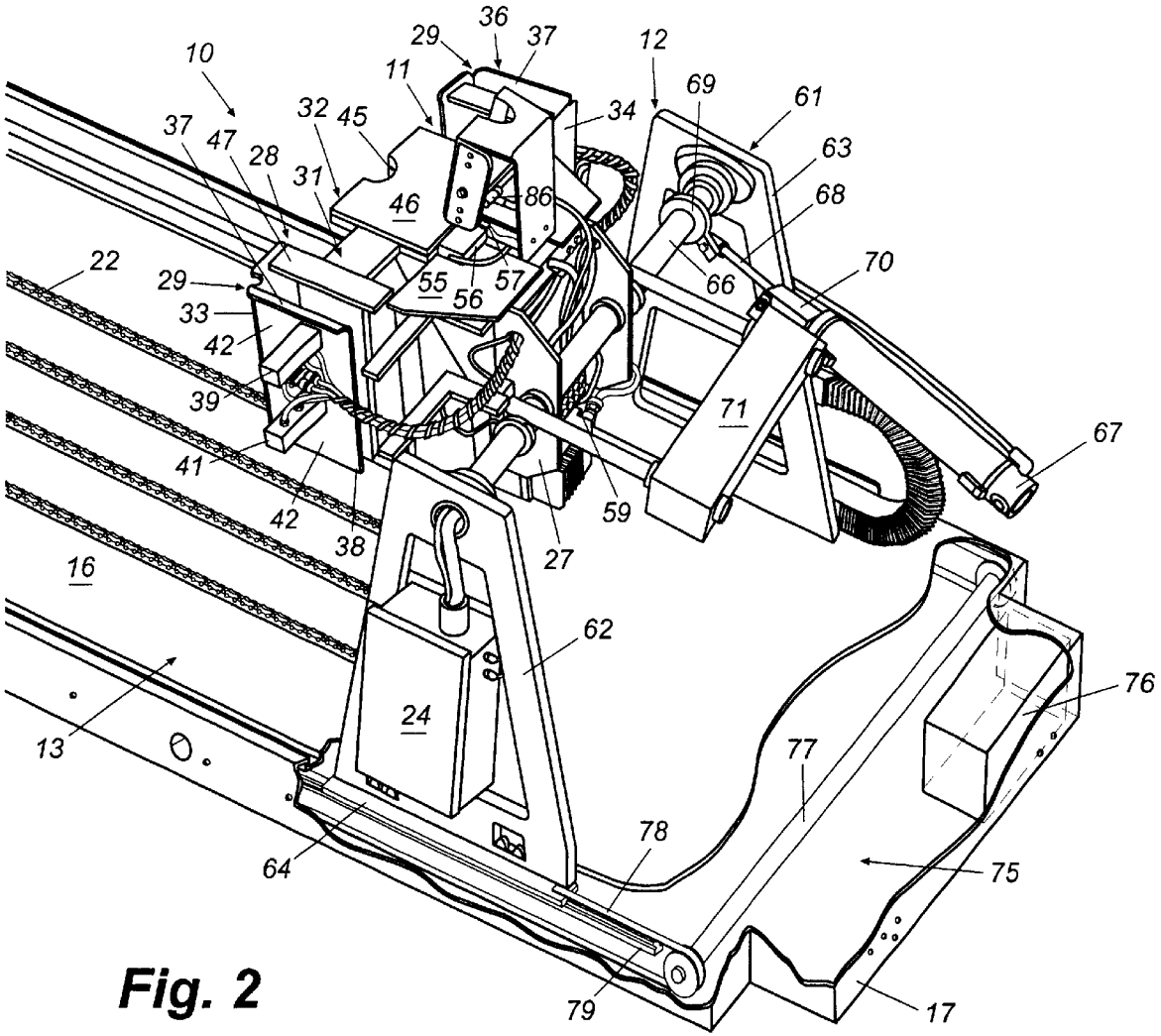
FIG. 2 is a perspective view showing the rear of the automatic carton loader of FIG. 1.

As illustrated in FIGS. 1, 2 and 4, the loader 11 generally is pivotally mounted to the carriage 12 and includes a frame 27. A guide assembly 28 is mounted on the frame and receives the stack S (FIG. 1) of cartons C when the loader 11 is in an upright, substantially vertically oriented first, receiving or loading position, as illustrated in FIG. 1. The guide assembly 28 generally includes a loading chute 29 that defines a loading area or zone 31, and a stacking platform 32. The loading chute includes a pair of opposed, substantially C-shaped chute members 33 and 34, each generally being formed from a metal such as stainless steel, although other materials can be used. Each of the chute members 33 and 34 has a substantially outwardly flared upper end 36 and form the sides or walls of the loading chute 29 defining loading zone 31. Inside each chute member is a side guide 37 for guiding the stacks of cartons into the loading chute, with each chute member further including a lower end 38.

As shown in FIGS. 1 and 2, adjustment cylinders 39 and 41 are mounted along the outer side wall or surface 42 of chute 33. Each of the adjustment cylinders 39 and 41 generally is a pneumatic, double acting cylinder and functions to adjust the position of the side guide 37 with respect to chute members 33 and 34, in order to adjust the size of the loading chute 31 as needed to accommodate varying sized cartons. The adjustment cylinders generally are controlled by the control system for the automatic carton loader, based upon programmed inputs as to the particular size of the cartons being loaded and stacked.

The stacking platform 32 is received and is moveable between the opposed chute members 33 and 34 for loading a stack of cartons, as indicated in FIG. 1. The stacking platform generally includes a center section 45, which typically has a non-stick upper surface 46 generally formed from a stainless steel, plastic or similar material to ensure that the cartons will not stick thereto, and a pair of side members or arms 47, that are received within the chute members to help guide the movement of the stacking platform between the chute members during a loading operation. The center section 45 of the stacking platform 32 is mounted to a platform cylinder 48 that controls the movement of the stacking platform between the opposed chute members. The platform cylinder 48 generally is a pneumatic, rodless cylinder, having a variable stroke, depending upon the size of the stacks of cartons being loaded on the carton loader. The platform cylinder 48 generally is oriented parallel to the stacking platform and is attached to a guide frame or carriage 49 for the stacking platform 32 for controlling the movement of the stacking platform. Platform sensors 51 and 52 (FIG. 1), which generally are proximity or other, similar type sensors such as photoelectric sensors, limit switches or the like, are mounted along one side of the platform cylinder in a position to detect the stacking platform as it is moved from a raised receiving or loading position, as indicated in FIG. 2, to a lowered, loaded position, as indicated in FIG. 1, and communicate such movement to the control system.

As illustrated in FIGS. 1 and 4, keeper plates 55 are mounted above the loading chute 31 and stacking platform 32. Each of the keeper plates 55 generally is formed from a metal, such as steel, although other types of materials having substantially smooth and/or non-stick surfaces also can be used. The keeper plates further can include a pad (not shown) formed from a non-stick material to ensure that the cartons being stacked within the loader will not stick to the keeper plates. Each of the keeper plates generally is connected to a cylinder rod of a double-acting, pneumatic keeper plate cylinder 56 (FIG. 4) mounted behind the loading chute 31. In response to the detection of the movement of the stacking platform into its fully lowered, loading position by the lower platform sensor 51 (FIG. 1), the keeper plate cylinder moves the keeper plates forwardly from a first, retracted or non-engaging position, as indicated in FIG. 2, into a second, extended or engaging position, wherein the keeper plates are extended out over the topmost carton of the stacks of cartons received on the stacking platform.

As shown in FIG. 1, a carton sensor 57 is positioned between the keeper plates 55, and generally is moveable from a first, retracted position when the keeper plates are in their retracted position, to a forwardly extended detecting or second position between the keeper plates with the movement of the keeper plates into their engaging position. The carton sensor 57 generally is a fiber optic, photoelectric sensor, such as manufactured by Omron, and detects the presence of the topmost carton of the stack of cartons. After the stacking platform has been initially lowered to its lowermost position, as detected by platform sensor 51, the control system moves the stacking platform vertically upward toward the extended keeper plates until detection of the cartons by carton sensor 57. Carton sensor 57 sends a signal to the control system for the carton loader upon the detection of the uppermost carton of the stack of cartons as the topmost carton engages the keeper plates, to halt any further movement of the stack of cartons against the keeper plates. As a result, the stack of cartons is engaged and held in a captured position between the chute members, stacking platform, and the keeper plates for reorientation and transport.

Figure 3:
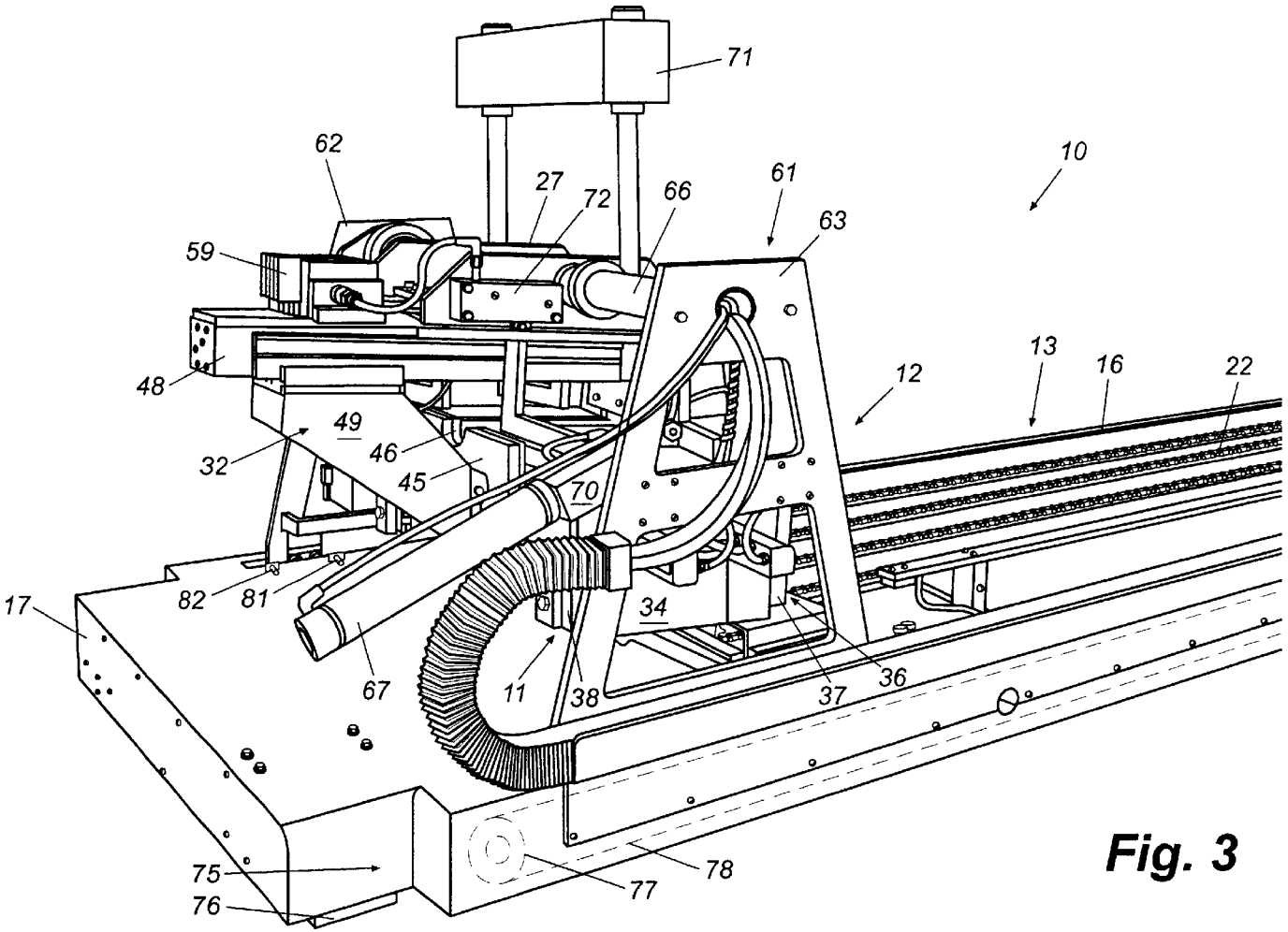
FIG. 3 is a perspective view of the automatic carton loader with the loader being in the lowered, stacking position.

As shown in FIGS. 2 and 3, a series of pneumatic control valves 59 are mounted along a rear surface of the frame 27 of the loader 11. The control valves 59 control the supply of air to the pneumatic control cylinders of the automatic carton loader, such as the keeper plate cylinder 56, platform cylinder 58, and adjustment cylinders of the chute members. The pneumatic control valves are located in a centralized position so that only a single air supply conduit needs to be extended to the controls for distribution to the various control cylinders.

As shown in FIGS. 1–4, the loader 11 is pivotally mounted on the carriage 12, which conveys the loader longitudinally along the table 16 of the mass feeder 13 from a home position, illustrated in FIGS. 1, 2 and 3, to a dispensing position for automatically depositing the stack of cartons contained within the loader against the accumulated supply of cartons 14, as illustrated in FIG. 4. The carriage 12 generally includes a frame 61 (FIGS. 1–4) having a pair of spaced side frame members 62 and 63. Each of the side frame members 62 and 63 generally is formed from steel or similar, high strength, durable material and typically is formed in an "A" frame shape or configuration, with the lower ends each side frame member generally mounted on a slide block 64 (FIGS. 1 and 2). As shown in FIGS. 2 and 4, a pivot shaft 66 is extended between the side frame members and supports the loader frame 27 at an intermediate position along the length thereof between the side frame members 62 and 63. The loader frame is thus able to pivot between its raised, loading position, illustrated in FIGS. 1 and 2, and its lowered, stacking position, illustrated in FIGS. 3 and 4.

A pivot cylinder 67 is mounted adjacent one of the side frame members 63 of the carriage and is connected to the loader frame for controlling the pivoting motion of the loader from its substantially vertically oriented position to its lowered stacking position. The pivot cylinder generally is a pneumatic, double-action cylinder having a cylinder rod 68 (FIG. 2) that is extensible from the cylinder 67. The cylinder rod 68 is connected at its free end to a crank arm 69 that is attached to the pivot shaft 66 and enables or causes the rotation of the loader by rotating pivot shaft 66 as the cylinder rod is extended and retracted into and out of the cylinder 67. The crank arm further enables adjustment of the angle of the loader with respect to the mass feeder table when the loader is in its stacking position by adjusting the point of connection of the crank arm to the pivot shaft.

A pneumatic locking collar 70 is incorporated with the pivot cylinder 67, with the cylinder rod 68 being extended therethrough. The locking collar engages the cylinder rod and prevents the uncontrolled retraction of the cylinder rod back into the pivot cylinder in the event of a loss of pressure in the pivot cylinder and/or as the pivot cylinder is deactuated. A counter-weight 71 (FIGS. 2–4) is further mounted to the frame 27 of the loader 11, generally for balancing the load as the frame is pivoted downwardly to avoid abrupt movements, or the cylinder 67 having to support high loads. A gravity switch 72 (FIG. 3) further is mounted along the loader frame 27 and senses the movement of the loader from its lowered, stacking position to its vertically oriented, receiving or loading position. As the loader reaches its vertically oriented loading position, the gravity switch 72 signals cylinder 67 to halt further movement of the loader 11 to accommodate different inclines or angles of the carriage when the mass feeder table is not level.

The automatic carton loader 10 further generally includes a drive system 75 for controlling the longitudinal movement of the carriage along the length of the table 16 of the mass feeder 13, toward and away from the accumulated supply of cartons 14. The drive system 75 is controlled by the control system for the automatic carton loader and typically includes a motor, shown in dashed lines 76 in FIG. 2, such as a 90 watt, AC electric motor or similar electric or pneumatic drive motor, mounted at the upstream or first end 17 of the table 16 of the mass feeder 13. The motor 76 drives a drive shaft 77, which in turn drives a pair of drive belts 78, each mounted and extending along opposite sides of the mass feeder table 16. The ends of the drive belts 78 generally are attached to the slide blocks 64 for each of the frame members of the carriage frame 61, and pull the carriage and loader forwardly and rearwardly between its dispensing and loading positions in response to the driving of the belts by the motor. As indicated in FIGS. 1 and 2, each slide block 64 of the frame members generally is supported and moved along a guide rail or slide 79. Each guide rail or slide 79 generally is formed from a reduced friction, plastic material, typically comprising a THK® linear guide manufactured by THK, Co. The guide rails 79 are mounted on each side of and extend substantially along the length of the mass feeder table for supporting and guiding the carriage along its path of movement along the mass feeder table.

As further indicated in FIGS. 3 and 4, a pair of carriage sensors 81 and 82 are mounted at the first or upstream end of the mass feeder table in a position to detect the presence of side frame member 62 of the carriage 12 when the carriage is moved to its home or rest position as indicated in FIGS. 2 and 3. Each of the carriage sensors generally is a proximity sensor that detects the presence of the side frame member. As the side frame member 62 of the carriage passes the first carriage sensor, a signal is sent to the control system of the automatic carton loader to slow down the further rearward movement of the carriage toward its home position. Upon detection of the side frame member 62 by the second carriage sensor, the control system is signaled to halt any further rearward movement of the carriage past its home position.

As further illustrated in FIGS. 1 and 2, a first, magazine stack approach sensor 85 is mounted at the upper end of the loader, while a second, magazine stack sensor 86 is mounted slightly below or downstream from the magazine stack approach sensor, with both sensors being positioned above or in front of the stack of cartons received and captured within the loader. As the loader is moved along the length of the mass feeder table toward the accumulated supply of cartons, the magazine stack approach sensor 85 will detect the trailing edge of the accumulated supply of cartons or the magazine plate 21 (FIG. 4), when in its raised position for supporting an initially loaded stack of cartons, and will signal the control system to slow down the further forward movement of the loader toward the accumulated supply of cartons. Thereafter, upon detection of the trailing edge of the accumulated supply of cartons or magazine plate by the magazine stack sensor 86 (FIG. 1), the control system is signaled to halt any further forward movement of the loader toward the accumulated supply of cartons. The magazine stack approach sensor and magazine stack sensor both are typically proximity sensors that detect the presence of the trailing edge of the accumulated supply of cartons for controlling the forward movement of the loader and signaling the start of the stacking phase of the automatic carton loader operation.

In operation of the automatic carton loader 10 of the present invention, a stack S of cartons C is received from a cross-transfer unit and is placed on the stacking platform 32 within the loading chute 29 of the loader 11. The control system of the automatic carton loader thereafter initiates an operational sequence starting with the lowering of the stack of cartons in a loaded position between the chute members of the loading chute. When the movement of the stacking platform to an initial loaded position is detected by platform sensor 51 (FIG. 1), the control system actuates a keeper plate cylinder to cause the keeper plates 55 to be moved into their engaging position above the top of the stack of cartons and, at the same time, causes carton sensor 57 to be moved forwardly to a detecting position between the keeper plates. The stacking platform then raises the stack of cartons toward engagement with the keeper plates until the carton sensor detects the top of the stack of cartons.

Thereafter, pivot cylinder 67 (FIG. 2) is engaged and retracts its cylinder rod 68 to cause the loader 11 to be pivoted downwardly, as indicated in FIG. 3, into a stacking position, wherein the stack of cartons within the loader is oriented at an angle approximately equivalent to that of the accumulated supply of cartons 14 (FIG. 4). With the loader reoriented into its stacking position, the carriage 12 is then moved forwardly along the length of the mass feeder table toward the accumulated supply of cartons 14. As the magazine stack approach sensor detects the trailing edge or carton of the accumulated supply of cartons, the control system is signaled to slow down the further forward movement of the carriage toward the accumulated supply of cartons. Thereafter, when the trailing edge or carton of the accumulated supply of cartons is detected by the magazine stack sensor, the further forward movement of the carriage is halted, and the keeper plates and carton sensor are retracted into their non-engaging positions to release the stack of cartons captured within the loader. The control system then reverses the operation of the drive system so as to cause the carriage to be moved rearwardly along the mass feeder table toward its home or rest position. At the same time, the stacking platform is moved forwardly through the loading chute so as to urge the stack of cartons out of the loading chute and against the accumulated supply of cartons as indicated in FIG. 4.

With the stack of cartons thus applied to or stacked against the accumulated supply of cartons on the mass feeder table, the carriage and loader are returned to their home or rest position. The cylinder 67 then extends its cylinder rod 68 to cause the loader to be pivoted to its vertically oriented, loading or receiving position for receiving additional stacks of cartons therein. The loading and stacking operation of the automatic carton loader of the present invention is repeated as needed to stack a sufficient supply or magazine of cartons on the mass feeder for feeding to the packaging machine to which the system is attached. Thereafter, as the accumulated supply or magazine of cartons is depleted, the automatic carton loader 10 can be signaled, either manually by an operator or automatically by a detector that detects the depletion of the accumulated supply of cartons below a desired level, to perform additional loading and stacking operations. As a result, the supply of cartons accumulated on the mass feeder can be automatically maintained at a desired level to provide a substantially continuous supply of cartons for the product packaging machine.

It will be understood by those skilled in the art that while the present invention has been discussed above with reference to particular embodiments, various modifications, additions and changes can be made to the present invention without departing from the spirit and scope of the present invention.

What is claimed:

1. A method of automatically loading stacks of product cartons for feeding into a packaging machine, comprising:

receiving a stack of cartons on a loader;

engaging the stack of cartons to hold the stack of cartons in a substantially stable position;

reorienting the loader with the stack of cartons contained therein from a raised loading position into a lowered stacking position with the cartons reoriented for stacking the stack of cartons adjacent previously loaded cartons on a feeder for the packaging machine;

moving the loader with the stack of cartons therein toward the previously loaded cartons;

detecting the previously loaded cartons with a first detector, slowing movement of the stack of cartons within the loader until the previously loaded cartons are detected by a second detector and thereafter halting further forward movement of the stack of cartons in the loader; and releasing the stack of cartons and urging the stack of cartons against the previously loaded cartons as the loader is moved away from the stack of cartons.

2. A method of automatically loading stacks of product cartons for feeding into a packaging machine, comprising:

moving a loader to a vertically oriented loading position;

sensing the loading position with a gravity switch and halting movement of the loader towards the loading position;

reorienting the loader with the stack of cartons contained therein from a raised loading position into a lowered stacking position with the cartons reoriented for stacking the stack of cartons adjacent previously loaded cartons on a feeder for the packaging machine;

moving the loader with the stack of cartons therein toward the previously loaded cartons; and releasing the stack of cartons and urging the stack of cartons against the previously loaded cartons as the loader is moved away from the stack of cartons.

3. A method of automatically loading stacks of product cartons for feeding into a packaging machine, comprising:

receiving a stack of cartons on a loader;

lowering the stack of cartons into a guide assembly, moving keeper plates into an engaging position over the stack of cartons and moving the stack of cartons into engagement with the keeper plates;

reorienting the loader with the stack of cartons contained therein from a raised loading position into a lowered stacking position with the cartons reoriented for stacking the stack of cartons adjacent previously loaded cartons on a feeder for the packaging machine;

moving the loader with the stack of cartons therein toward the previously loaded cartons; and releasing the stack of cartons and urging the stack of cartons against the previously loaded cartons as the loader is moved away from the stack of cartons.

4. The method of claim 3 and further comprising sensing the previously loaded cartons and halting further movement of the stack of cartons toward the previously loaded cartons.

5. The method of claim 3 and wherein releasing the stack of cartons comprises moving the keeper plates out of engagement with the stack of cartons and moving a support forwardly to urge the stack of cartons out of the loader as the loader is moved away from the stack of cartons.

6. The method of claim 3 and wherein reorienting the stack of cartons comprises moving the stack of cartons to an angle approximately aligned with an angle of the previously loaded cartons.

7. A method of automatically loading stacks of cartons for feeding into a product packaging machine, comprising:

receiving a stack of cartons within a guide assembly of a carton loader;

capturing the stack of cartons within the carton loader;

moving the carton loader from a loading position to a stacking position with the stack of cartons reoriented so as to be substantially aligned with a series of previously loaded cartons to be fed into the packaging machine;

moving the carton loader toward the previously loaded cartons;

detecting the previously loaded cartons with a first detector, slowing movement of the stack of cartons within the loader until the previously loaded cartons are detected by a second detector and thereafter halting further forward movement of the stack of cartons in the loader; and depositing the stack of cartons within the carton loader against the previously loaded cartons.

8. The method of claim 7 and wherein capturing the stack of cartons comprises lowering the stack of cartons into a guide assembly, moving keeper plates into an engaging position over the stack of cartons and moving the stack of cartons into engagement with the keeper plates.

9. The method of claim 7 and wherein depositing the stack of cartons comprises moving keeper plates out of engagement with the stack of cartons and moving a support forwardly to urge the stack of cartons out of the loader as the loader is moved away from the stack of cartons.

10. The method of claim 7 and wherein moving the carton loader from a loading position to a stacking position comprises pivoting the carton loader from a substantially vertically oriented position to a lowered stacking position.

11. The method of claim 10 and wherein moving the carton loader from a loading position to a stacking position comprises sensing the loading position with a gravity switch and halting movement of the loader towards the loading position.

12. An automatic carton loader for automatically loading a stack of product cartons into a packaging machine, comprising:

a carriage movable along a feeder table between a home position for receiving a stack of cartons and a dispensing position for depositing the stack of cartons adjacent previously loaded cartons accumulated on the feeder table;

a loader mounted to the carriage and movable between a substantially vertically oriented loading position for receiving the stack of cartons and a lowered stacking position for placing the stack of cartons adjacent the previously loaded cartons, said loader further comprising a guide assembly adapted to receive and hold the stack of cartons within the loader in a substantially captured position for reorienting and movement of the stack of cartons to the dispensing position.

13. The automatic carton loader of claim 12, further comprising a pivot cylinder connected to the loader and controlling movement of the loader between the substantially vertically oriented loading position and the lowered stacking position.

14. The automatic carton loader of claim 12, further comprising a magazine stack approach sensor mounted on said loader in a position to initially detect the previously loaded cartons as the carriage moves toward the dispensing position, in response to which, the automatic carton loader slows movement of the carriage towards the dispensing position upon detection of the previously loaded cartons by the magazine stack approach sensor; and a magazine stack sensor adjacent the magazine stack approach sensor, wherein the automatic carton loader halts further movement of the carriage at the dispensing position upon detection of the previously loaded cartons by the magazine stack sensor.

15. The automatic carton loader of claim 12, wherein, upon the loader moving to the stacking position, the stack of cartons within the loader is oriented at an angle approximately aligned with an angle of the previously loaded cartons.

16. The automatic carton loader of claim 12, further comprising a drive system including:

a motor;

a drive shaft driven by said motor;

a pair of drive belts driven by said drive shaft, said drive belts extending along opposite sides of the feeder table and attached to slide blocks on a carriage frame for pulling the carriage between the home position and the dispensing position.

17. The automatic carton loader of claim 12, further comprising a gravity switch that senses movement of the loader from the stacking position to the loading position and halts movement of the loader as the loader reaches the loading position.

18. The automatic carton loader of claim 12, wherein the guide assembly comprises:

a loading chute including opposed chute members;

a stacking platform movable between the opposed chute members for loading the stack of cartons within the guide assembly; and at least one keeper plate mounted above the loading chute and the stacking platform, and movable into an engaging position over the stack of cartons received on the stacking platform to hold the stack of cartons in the substantially captured position.

19. The automatic carton loader of claim 18, wherein the stacking platform is movable between the chute members to urge the stack of cartons out of the loading chute and against the previously loaded cartons.

20. The automatic carton loader of claim 19, further comprising a platform cylinder attached to a guide frame for the stacking platform and controlling movement of the stacking platform.

21. The automatic carton loader of claim 18, wherein the at least one keeper plate is pivotally mounted above the loading chute so as to be moveable between a non-engaging position and the engaging position.

22. The automatic carton loader of claim 21, further comprising at least one keeper plate cylinder for moving the at least one keeper plate between its non-engaging and engaging positions.

* * * * *